United States Patent [19]

Arce

[11] Patent Number: 4,760,689

[45] Date of Patent: Aug. 2, 1988

[54] IMPROVEMENTS IN SPINNING RING ASSEMBLY FOR TEXTILE TWISTING APPARATUS

[76] Inventor: Raúl O. Arce, Calle Cordovanes No. 25, San Jose Insurgentes Mexico, DF Mexico, Mexico

[21] Appl. No.: 941,735

[22] Filed: Dec. 15, 1986

[30] Foreign Application Priority Data

Dec. 16, 1985 [MX] Mexico ..... 98424014

[51] Int. Cl.[4] ..... D01H 7/56

[52] U.S. Cl. ..... 57/124; 57/119; 57/122

[58] Field of Search ..... 57/119, 122, 124, 75

[56] References Cited

U.S. PATENT DOCUMENTS

| | | | |
|---|---|---|---|
| 2,725,712 | 12/1955 | Rooney | 57/124 |
| 3,494,120 | 2/1970 | Chilpan et al. | 57/122 X |
| 4,112,666 | 9/1978 | Costales et al. | 57/122 X |
| 4,114,359 | 9/1978 | Creus | 57/124 |
| 4,270,340 | 6/1981 | Baucom et al. | 57/124 X |
| 4,302,927 | 12/1981 | Hope, Sr. | 57/122 |
| 4,343,145 | 8/1982 | Barro | 57/124 |
| 4,596,114 | 6/1986 | Donnelly | 57/124 |

*Primary Examiner*—John Petrakes

*Attorney, Agent, or Firm*—Jones, Tullar & Cooper

[57] ABSTRACT

Improvements in a spinning ring assembly for textile twisting apparatus are disclosed. A support structure that is attachable to a twisting unit supports an inside friction ring by means of a freely rotatable bearing assembly. A traveler is positioned on an upper surface of a spinning ring for free movement. The spinning ring is carried by an intermediate free supporting ring which is in contact with the inside friction ring.

1 Claim, 1 Drawing Sheet

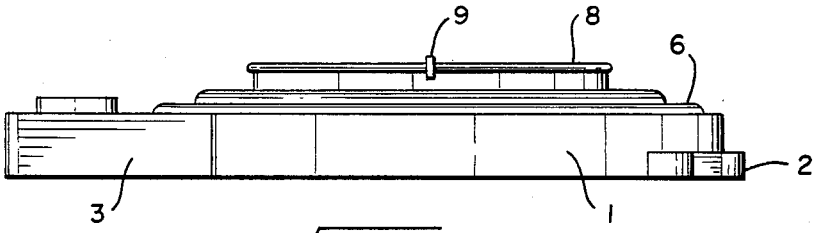
FIG 1
FIG 2
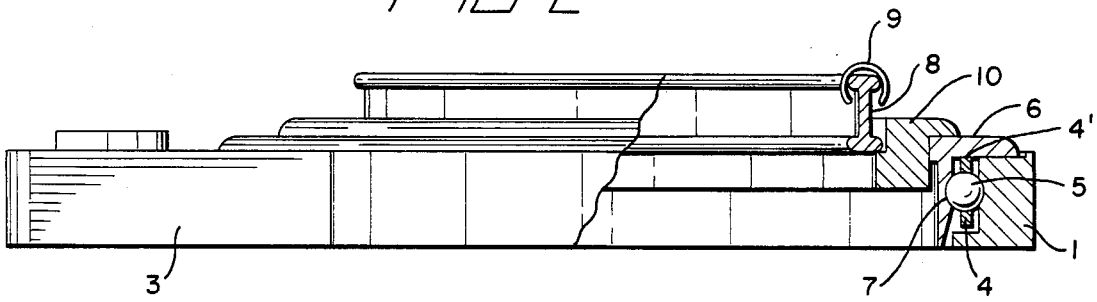
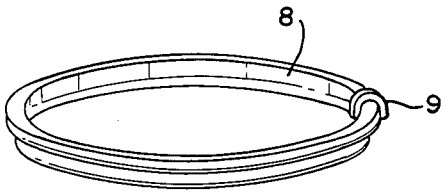
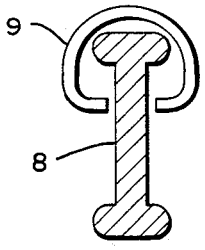
FIG 3
FIG 2a
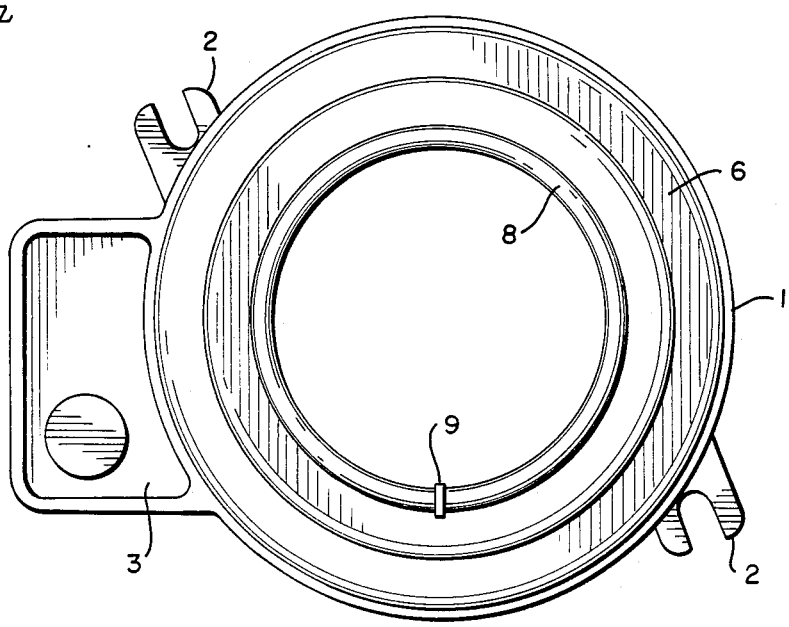
FIG 4

IMPROVEMENTS IN SPINNING RING ASSEMBLY FOR TEXTILE TWISTING APPARATUS

FIELD OF THE INVENTION

This invention has to do with improvements in the construction of spinning ring assemblies used in thread making machines known as twisting machines, where the thread is formed by the rotation of a spindle. The present invention means a considerable increase in the operation and productivity of the twist apparatus, without affecting the machine's operation and functioning.

DESCRIPTION OF THE PRIOR ART

In twisting machines, the mechanical formation of the thread is mainly achieved by means of a spinning ring assembly, through which the spindle passes. The spindle has a longitudinal displacement and carries a spool for rotation on its own axis. As the spindle rotates, thread is formed. The spinning ring assembly is attached to the twist frame table and has a traveler which freely turns with the spindle.

The movements of the spindle and the traveler necessarily set a limit to the spindle's displacement and the traveler's rotation, which in turn means that the twister's productivity is in fact limited by the design and operation of conventional spinning ring assemblies.

SUMMARY OF THE INVENTION

It is an object of the present invention to provide an improvement in the constructon of spinning ring assemblies used in thread forming machines such as twisters.

This invention, when used industrially, can lead to a considerable increase in the twister's yield by allowing the spindle and the rotation of the traveler to go at a considerably faster pace, without detriment to the final product.

This considerable increase in the speed of rotation of the sindle requires anti-friction devices which, if not provided by the present spinning ring assembly, would mean that the spindle or the twisted thread would constantly be breaking, which in turn would lead to a drop in the productivity of the twisting apparatus.

These anti-friction measures are accounted for in this invention through improvements in the spinning ring assembly. By means of the rotation of the spinning ring assembly and the traveler, the relative speed of the spindle, the spool, and the traveler is much lower than in the case of the conventional ring—consequently the possibility of deterioration or harm to the thread in process is reduced.

Basically this invention provides improvements in spinning rings for the manufacture of thread. This invention leads to a drop in the relative speed between the spindle, the traveler, and the spinning ring assembly, which, in turn, considerably increases the allowance speed of movement of the spindle through the ring. These improvements include the addition of a free intermediate ring to support the spinning ring, and also includes a means of freely revolving or ball bearings that can be rotated, drawn by the spindle and the traveler so that this rotation of the free intermediate ring leads to a relative speed between the spindle, the traveler, and the free intermediate support ring, which is considerably less than the relative speed of conventional fixed rings.

These improvements also provide a combination of measures that eliminate the need to resort to turbines, mechanical, or mechanical-pneumatic measures to move the support ring assembly and to make it rotate, noticeably lowering the cost of the device since the design has been markedly simplified because the support ring freely mounted on the spinning ring assembly is turned by the traveler as it is displaced by the thread being spun.

BRIEF DESCRIPTION OF THE DRAWINGS

While the novel features of the improvements in spinning ring assemblies for textile twisting machines are set forth with particularly in the appended claims, a full and complete understanding of the invention may be had by referring to the detailed description of the referred embodiment, as is set forth subsequently, and as may be seen in the accompanying drawings, in which:

FIG. 1 is a side elevation view of the spinning ring assembly for the twisting apparatus according to the present invention;

FIG. 2 is a side elevation view, partly in section, of the present inventon and showing the ball bearing or bearings that allow free rotation of the inside friction ring;

FIG. 2-A is a perspective view of the traveler that is freely mounted on the top part of the spinning ring;

FIG. 3 is a cross-sectional view of the spinning ring and showing the traveler freely secured to the spinning ring; and FIG. 4 is a top plan view of the unit as a whole and showing the traveler.

DESCRIPTION OF THE PREFERRED EMBODIMENT

In this invention the unit functionally includes a support structure 1 which allows the unit to be attached to the twisting ring table (not shown). Support structure 1 can include a projection 3, which can accommodate a strip of felt or a similar means (not shown) to store lubricating oils, which is the reason why this projection is connected to the lower part of the structure itself.

Support structure 1 carries and secure on an inner surface thereof a ball bearing or similar bearing assembly 4, which has an upper edge support 4' and a set of small ball bearings or other bearings 5 that sustain, in free rotation, an inside friction ring 6 of the spinning ring assembly. This inside friction ring 6 has an outer surrounding circumferential groove 7 where the ball bearings 5, as can be seen in FIG. 2 are carried. Friction ring 6 also has an inside projection which supports an intermediate free support ring 10 that, in turn, carries a spinning ring 8 on whose upper surface a traveler 9 is freely carried. Spinning ring 8 is illustrated by itself in FIG. 2-A and set in position in FIG. 2.

The spindle rotates and moves axially and forms the thread as it twists. The spinning ring 8 rests on, and is supported by free intermediate ring support 10 and supports traveler 9 so that the spindle's longitudinal displacement and the spindle's rotation lead to the rotation of the intermediate support ring 10 through the spinning ring 8 and the traveler 9 supported by it.

The inside friction ring 6 is mounted freely on the support structure 1 by way of bearings 5. Friction of the thread with the spinning ring 8 and traveler 9 and the spindle is considerably reduced, while conserving the device's property of twisting the spinning ring assembly to make thread. The combined action of the inside friction ring 6 and the indirect mounting of traveler 9 to this ring and the movement of the spindle lead to a spinning ring assembly of improved characteristics, which results in better thread yield and productivity by allowing for more speed in the movement of the spindle with no detriment to thread quality.

The characteristics of this invention are as stated in this description and illustrations. Traveler 9 freely operates and is indirectly supported by inside friction ring 6, and at the beginning of the operation drags inside friction ring 6 and makes it spin because it is mounted on anti-friction bearings so that it almost reaches the rotation speed of the spindle or the thread being spun, so that these relative speeds have been reducted to a minimum and do not damage the thread. This in turn allows for a more continuous operation, without costly interruptions.

Similar devices are now available where there are mechanical or pneumatic means to drive the support ring assembly and even the traveler 9, but they involve a complicated constructon process and are obviously more costly and break down more frequently.

While a preferred embodiment of an improved spinning ring assembly for a twisting apparatus is set forth hereinabove, it will be apparent to one of skill in the art that various changes could be made without departing from the true spirit and scope of the present invention which is accordingly to be limited only by the following claims.

What is claimed is:

1. A spinning ring assembly for a textile twisting apparatus useable in a thread making machine including a rotatable spindle, said spinning ring assembly comprising:

a support structure including means for attaching said support structure to the thread making machine;

a ball bearing assembly secured to and carried on an inner surface of said support structure;

an inside friction ring having an outer circumferential groove which contacts balls of said ball bearing assembly, said inside friction ring being sustained in free rotation by said ball bearing assembly;

an intermediate free support ring support on an inner projection of said inside friction ring;

a spinning ring carried by said intermediate support ring; and a traveler freely carried on an upper surface of said spinning ring.

* * * * *